US009194114B2

(12) United States Patent
Petry

(10) Patent No.: US 9,194,114 B2
(45) Date of Patent: Nov. 24, 2015

(54) DRAIN PIPE CLEANING DEVICE AND METHOD

(71) Applicant: Marvin Petry, Potomas, MD (US)

(72) Inventor: Marvin Petry, Potomas, MD (US)

( * ) Notice: Subject to any disclaimer, the term of this patent is extended or adjusted under 35 U.S.C. 154(b) by 44 days.

(21) Appl. No.: 13/694,800

(22) Filed: Jan. 8, 2013

(65) Prior Publication Data

US 2014/0190516 A1 Jul. 10, 2014

(51) Int. Cl.
*B08B 9/045* (2006.01)
*E03C 1/302* (2006.01)

(52) U.S. Cl.
CPC ..... *E03C 1/302* (2013.01)

(58) Field of Classification Search
CPC ..... E03C 1/302
USPC ..... 134/8; 15/104.03, 104.05, 15/104.66–104.69, 104.31, 104.32, 15/104.16, 104.33
See application file for complete search history.

(56) References Cited

U.S. PATENT DOCUMENTS

| | | | | | |
|---|---|---|---|---|---|
| 584,508 | A | * | 6/1897 | Hughes | 15/104.31 |
| 1,051,992 | A | * | 2/1913 | Fisher er al. | 15/104.32 |
| 1,308,469 | A | * | 7/1919 | Amet | 15/104.16 |
| 1,312,404 | A | * | 8/1919 | Klarmann | 15/104.31 |
| 1,588,737 | A | * | 6/1926 | Hurd | 15/104.33 |
| 2,255,914 | A | * | 9/1941 | Crane | 15/104.061 |
| 2,517,227 | A | * | 8/1950 | O'Leary | 15/104.09 |
| 3,195,548 | A | * | 7/1965 | Lestakis | 134/167 R |
| 4,001,911 | A | * | 1/1977 | Watson | 15/104.33 |
| 4,337,096 | A | * | 6/1982 | Clifford | 134/8 |
| 4,358,861 | A | | 11/1982 | Sard | |
| 4,771,500 | A | * | 9/1988 | Kovacs | 15/104.33 |
| 4,774,739 | A | * | 10/1988 | Sherman, Jr. | 15/104.33 |
| 4,795,495 | A | * | 1/1989 | Dobson, Sr. | 134/8 |
| 5,335,388 | A | * | 8/1994 | Salecker | 15/104.12 |
| 5,418,997 | A | * | 5/1995 | DeFrange | 15/104.31 |
| 5,745,948 | A | * | 5/1998 | Lloyd et al. | 15/104.12 |
| 5,765,251 | A | * | 6/1998 | Jones | 15/104.32 |
| 5,769,960 | A | * | 6/1998 | Nirmel | 134/22.11 |
| 5,819,354 | A | * | 10/1998 | Alonso et al. | 15/104.05 |
| 5,836,032 | A | * | 11/1998 | Hondo | 15/104.32 |
| 6,058,547 | A | * | 5/2000 | Foster | 15/104.12 |
| 6,131,229 | A | * | 10/2000 | Lincuna et al. | 15/104.33 |
| 6,161,563 | A | * | 12/2000 | Mankins | 137/15.14 |
| D435,944 | S | | 1/2001 | Luoma | |
| 6,187,105 | B1 | * | 2/2001 | Matlschweiger | 134/8 |
| 6,276,018 | B1 | * | 8/2001 | Leiman et al. | 15/104.19 |
| 6,421,871 | B1 | * | 7/2002 | Peach et al. | 15/104.33 |

(Continued)

*Primary Examiner* — Alexander Markoff

(57) ABSTRACT

A drain cleaner for cleaning entangled obstructions such as a clog from a drain pipe such as a sink, tub or shower. A rod extending into the drain pipe is formed of a material which is either metal or plastic but stiff enough that it will not buckle but flexible enough to bend around curves. Arms connected to the distal end of the rod normally flex outwardly such that when the arms are inserted into the pipe they are resiliently flexed against the inside wall of the pipe, the arms being circumferentially spaced apart from each other to create spaces between them and each arm can each flex resiliently independent of the other arms. The device may push some of the clog through to be washed out of the pipe. Obstruction material which is not moved downstream will then be grasped by the arms as the arms move outwardly against the inside wall of the pipe. The rod is then pulled back rearwardly toward the drain opening and the arms catch the obstruction material which did not get flushed downstream, and pull the obstruction material rearwardly to and out of the drain opening. A method for cleaning a drain pipe using the device of the present invention.

8 Claims, 4 Drawing Sheets

(56) References Cited

U.S. PATENT DOCUMENTS

| | | | | |
|---|---|---|---|---|
| 6,564,823 | B1 * | 5/2003 | Mankins | 137/318 |
| 6,699,331 | B1 * | 3/2004 | Kritzler | 134/8 |
| 6,775,873 | B2 | 8/2004 | Luoma | |
| 6,827,794 | B2 * | 12/2004 | Sommerfeld, Sr. | 134/8 |
| 6,920,663 | B2 * | 7/2005 | Petit | 15/104.33 |
| 7,584,513 | B2 | 9/2009 | Turner | |
| 8,365,337 | B2 * | 2/2013 | Tash | 15/104.33 |
| 2009/0083915 | A1 * | 4/2009 | Cicchelli et al. | 15/3 |
| 2010/0132101 | A1 * | 6/2010 | Bates et al. | 4/255.04 |
| 2010/0132143 | A1 * | 6/2010 | Flamand | 15/104.33 |
| 2011/0083289 | A1 * | 4/2011 | Heatley-Adams et al. | 15/22.2 |
| 2011/0289706 | A1 * | 12/2011 | Fivecoate | 15/104.33 |

* cited by examiner

DRAIN PIPE CLEANING DEVICE AND METHOD

FIELD OF THE INVENTION

This invention relates to cleaning obstructions from drain pipes.

BACKGROUND OF THE INVENTION

Drain pipes for drains of all types, including large industrial drains and smaller domestic drains such as in sinks, tubs and showers are susceptible to being blocked by obstructions. While it is understood that the principles of the present invention are applicable to all types of drain pipes, the invention will be described herein particularly with respect to domestic home drain pipes such as in sinks, tubs, showers and floor drains as may be found in a laundry room or basement.

Drain pipes, especially of the type in a home, generally have a U-shaped water seal located just downstream of the drain opening wherein the drain pipe follows a U-shaped path, the purpose of such a water seal being to prevent gases and the like from passing from the inside of the pipe up into the room above the drain opening. The problem, however, is that this U-shaped water seal is a natural space for materials such as hair, soaps, oil and greases to collect, and more than just collect, they become entangled to form a clog which is resistant to being removed.

The prior art discloses devices intended to remove such clogs. However, prior drain pipe cleaning devices suffer from disadvantages including the fact that they are often complex, expensive and/or inefficient.

Thus, a need exists for improvements in drain pipe cleaners which are suitable for cleaning drain pipes of any size or type but especially for removing clogs from household drain pipes.

SUMMARY OF THE INVENTION

The present invention provides a drain pipe cleaning device which is simple to construct and operate and which, at the same time, is highly efficient. The present invention also includes a method of cleaning a drain pipe using the device of the present invention.

According to the present invention, there is provided an elongated rod having sufficient length and flexibility to extend into and through a curve in a drain pipe such as a U-shaped water seal. The proximal end of the device includes a handle of any suitable type so that the user can manipulate the cleaning device from above the drain opening. At its distal end, the device includes a series of resiliently outwardly biased arms connected at or near the distal end of the rod and extending back toward the drain opening so that as the rod and arms move through the drain pipe, the arms flex outwardly against or toward the inside wall of the drain pipe.

The arms are spaced apart circumferentially from each other so as to create a space between them. This space allows the device to be pushed through at least a portion of the clog to push some of the clog downstream to be washed out and/or to permit the device to move all the way through the clog beyond the remaining clog material so that the arms can then flex outwardly against the inside wall of the pipe to grasp substantially all of the remaining clog material to efficiently pull the clog or the remaining portion of the clog rearwardly up the drain pipe to and through the drain opening.

A minimum of two arms may be provided. The number of arms is related to the desired space between the arms to facilitate movement of the arms through the clog. The reason why only a few arms can pull back the clog material is that the clog is a fibrous entangled mass such that if engaged at only a minimum number of locations, the whole mass will be held by the arms as the rod is pulled back. In a situation where the clog material is less entangled, one could simply utilize more arms.

The spaced apart arms are resilient so as to flex outwardly toward or against the inside wall of the pipe, the rod is pushing the arms downstream through the drain pipe and during the rearward movement, to the drain opening. The arms can be thin but strong, such as a resilient wire or they can be flat arms. The rod and arms can be made out of any suitable materials such as metal or plastic. In the case of a metal device, the arms could be made of thin wire or flat metal strips. Or the entire unit, including the rod and the arms, could be molded out of plastic.

The arms should not hit a snag on the inside wall of the drain pipe as the arms are being pulled back toward the drain opening. To facilitate this, the arms may be constructed with catch-free proximal ends. For example, their proximal ends may be bent inwardly so that a portion of the arms spaced distally from those ends actually engages the inside wall of the pipe. Alternatively, the arms can be formed with large balls or the like at their proximal ends, which balls would be constructed to ride along the inside wall of the pipe in a manner which moves over snags. A "snag" is defined as anything that could prevent movement of the arms back towards the drain opening. Examples include irregularities, on the inside of the drain pipe, ridges, levers projecting into the drain pipe or openings in the side of the drain pipe.

For example, some drains include a lever extending into the interior of the pipe to hold a valve to open or close the drain opening. In a sink with a poppet valve, even after the poppet valve mounting rod has been removed, there remains relatively large openings in the side wall of the pipe which are exposed after the poppet valve mounting rod has been removed. With the present invention, there is a space between the arm such that if an arm hits any snag such as the said openings, the device can be rotated so that the lever, opening or other snag can be located in a space between the arms so that the arms can move up the drain pipe around the snag to carry the clog all the way to and through the drain opening.

The device could be constructed specifically for a given size pipe or constructed to work well in pipes over a different range of pipe sizes. For example, in a household a bathroom sink drain pipe has an inside diameter of approximately one inch while a tub and shower drain have a larger inside diameter of approximately two inches and a kitchen sink drain would generally have a larger inside diameter of about three inches. The drain cleaning device of the present invention could be sized specifically for any one of these or of a size to fit a plurality of pipe sizes.

As noted above, the present invention can be used in virtually any drain pipe provided it is sufficiently unobstructed that the device of the present invention can pass through the drain pipe. This would be true for virtually any type of drain where the only mechanism for preventing flow into the drain is a removable stopper or grate covering the drain opening. Kitchen sink drains, obviously without an installed garbage disposal, will generally be sufficiently open for use of the present device. Stall showers and floor drains would generally have a grating over the drain opening which, when removed, would provide an unobstructed opening for use of the present device. Bathtubs with levers mounted on a vertical wall of the bathtub and operating a valve located internally within the drain pipe, downstream from the drain opening, present more of a problem since it is necessary to access that internal valve from the outside of the bathtub. This would generally be beyond the abilities of a homeowner but if the services of a professional such as a plumber were utilized to remove the internal valve of the tub, then the opening would indeed be sufficiently unobstructed that one could then use the device of the present invention to clean the drain pipe of that tub. With the present invention, as noted above, since there are spaces between the arms, if the device engaged such a lever or the like when being pulled rearwardly out toward the drain opening, the user could simply rotate the device until the lever or the like was located in a space between adjacent arms after which the device could simply be pulled out of the tub drain opening.

For a bathroom sink of the type having a poppet valve, the user will need to remove the poppet valve before the present device can be used. However, since bathroom sinks are probably the most frequent location of entangled clogs, it would often be to the user's advantage to take the extra effort required. Specifically, the user would have to remove the poppet valve by first removing the poppet valve mounting rod which is generally located downstream from the drain opening and upstream from the U-shaped water seal.

Removing the poppet valve mounting rod leaves relatively large openings in the side wall of the pipe where the poppet valve mounting rod was located. With the present invention, if the arms get caught in these large holes, the user would simply push the device slightly down, back into the drain pipe and rotate it so that the proximal ends of the arms pass upwardly around these openings.

As noted above, in accordance with the present invention, there is a space between the arms. This space facilitates downstream movement of the arm to, into and through the clog. In addition, the space between the arms allows the arms to be manipulated around snags in the pipe such as irregularities, levers, or openings so that the arms can continue their rearward movement to carry the clog all the way through and out of the drain opening. It would be within the knowledge of one of ordinary skill in the art to select the number of arms and the thickness of the arms and thus the size of the spaces between the arms, as best suited for the type of clog or other entangled obstruction which would be encountered, as well as the types of snags to be encountered. At one extreme, if the clog is sufficiently entangled, a minimum of two arms may be provided. Depending on the nature of the clog material and the expected snags, three, four or more arms may be provided. At some point, for a given application, too many arms may leave an insufficient space between the arms for suitably avoiding the snags while pulling the device rearwardly out of the drain opening.

Another advantage of having a spaces between the arms is that if, as shown, each arm is connected to the rod independently of the other arms, then each arm can flex independently of the other arms. This could be advantageous in many circumstances. For example, during pulling back of the device toward the drain opening, if one arm got caught up on a particularly resistant piece of clog material, and the other arms were not so caught up, the user could keep pulling the rod such that all arms except the caught arm would continue to move rearwardly toward the drain opening, causing a greater force to be applied by the caught arm on the resistant clog material, or the caught up clog could break free, permitting the device to be reinserted down the pipe to try again to remove the resistant piece of clog material.

Thus, it is an object of the present invention to provide new and improved device for cleaning drain pipes.

It is another object of the present invention to provide a drain pipe cleaning device particularly suitable for home use.

It is still another object of the present invention to provide a drain pipe cleaning device which is simple, effective and efficient.

It is still another object of this invention to provide a method for cleaning a drain pipe using the device of the present invention.

BRIEF DESCRIPTION OF THE DRAWINGS

Preferred embodiments of the present invention will become more apparent from the detailed description to follow, together with the accompanying drawings, wherein.

DETAILED DESCRIPTION OF THE PREFERRED EMBODIMENTS

Figure 1:
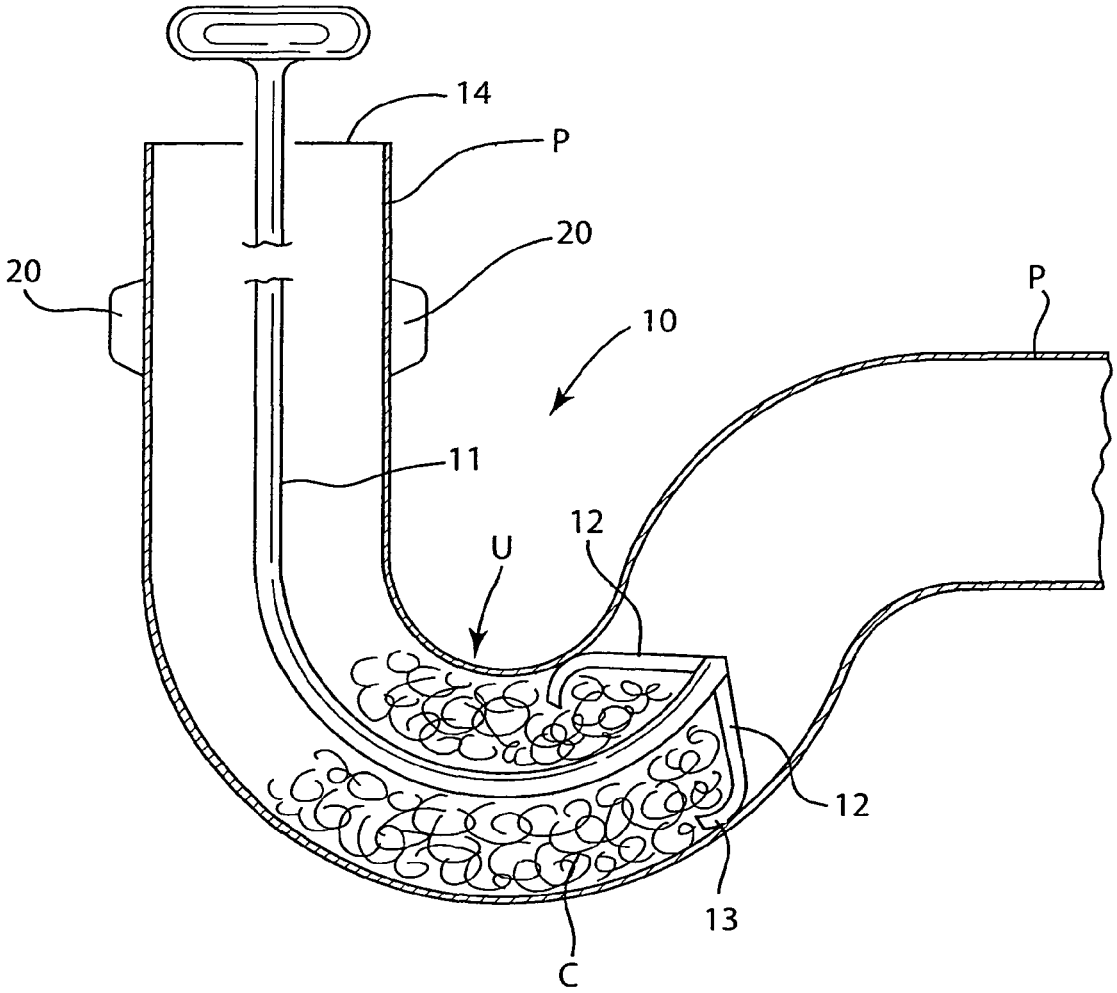
FIG. 1 is a cross-sectional view of a typical drain pipe showing the drain cleaning device in use.

Referring now to the drawings, like elements are represented by like numerals throughout the several views. FIG. 1 illustrates the drain cleaning device 10 of the present invention in operation. An elongated rod 11 made of metal or plastic has sufficient rigidity that it does not buckle, while on the other hand it is sufficiently flexible to bend around curves in a pipe. The proximal end of the rod includes a handle or the like for the user to grasp the rod 11. As is typical in domestic drains, the pipe P has a U-shaped portion, which serves as a water seal U to prevent gases downstream of the pipe from discharging into the room above the drain opening 14. In a bathroom sink drainage pipe which includes a rod extending across the pipe to grasp a poppet valve, the poppet valve must be removed for the present invention to be used therein. In FIG. 1 the poppet valve has been removed. The fittings 20 represent diametrically opposed openings with holes through which a rod would extend to mount a poppet valve.

At the distal end of the cleaning device, the rod has mounted thereon a plurality of resilient arms 12, the proximal ends of which are bent inwardly to form catch-free ends so that curved parts 13 of the arms 12 engages the inside wall of the pipe. In operation, the cleaning device would be utilized to remove clog material C which in a domestic environment would include soap, oils, hair and the like. Because the clog includes hairs, it becomes a relatively entangled mass such that if it is grasped at only a few points, for example by two arms, and the rod is pulled rearwardly back toward the drain opening, it will tend to take much if not all of the clog with it.

Figure 2:
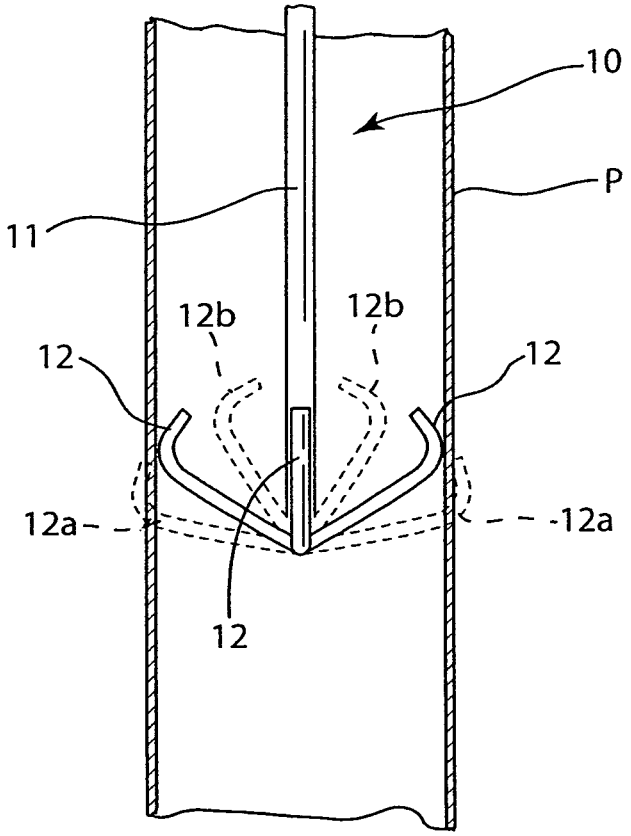
FIG. 2 illustrates the distal portion of the device in a vertical section of a drain pipe so as to illustrate its principle of operation.

FIG. 2 illustrates the distal end of rod 11, shown for purposes of illustration in a vertical section of a pipe. The distal end of rod 11 includes arms 12 with curved parts 13. FIG. 2 illustrates these arms in solid lines where they engage the inside wall of the pipe as the cleaning device moves downwardly and rearwardly therein. The dotted lines 12*a* illustrate the natural relaxed position of the arms which places them on a diameter greater than the inside diameter of the pipe. Thus, when the rod 11 is inserted into the drain pipe, the arms will be resiliently bent inwardly just enough that within the pipe their resilience urges them outwardly against the inside wall of the pipe. As shown in the drawings, the arms, by their resilient engagement with the inside of the drain pipe, essentially center the rod within the drain pipe, in the vicinity of the arms. Dotted lines 12*b* show the arms 12 bent resiliently inward which position they might assume while the cleaning device 10 is being pushed downwardly through a clog C.

Figure 3:
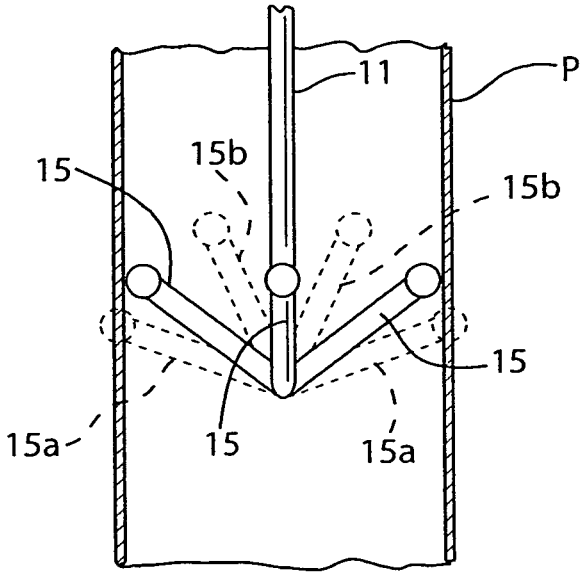
FIG. 3 is a view similar to FIG. 2 but showing a modification.

FIG. 3 is similar to FIG. 2 but shows a modification wherein the arms 15 have at their proximate ends enlarged balls 16. FIG. 3 also illustrates in dotted lines the relaxed position 15*a* of the arms 15 and inwardly bent positions 15*b*, which correspond to positions 12*a* and 12*b* of FIG. 2.

Some drain pipes may have snags in the form of relatively large openings in the sides of the pipe such as poppet valve mounting openings 20 shown in FIG. 1. If an arm passes directly over such an opening, notwithstanding its catch-free end, the arm could flex outwardly and get caught in one of these openings. With the present invention, as noted above, since the arms are spaced apart, if the proximal end of an arm does enter one of these openings, the user simply pushes the rod downwardly until the proximal ends of the arms are below the openings 20, and then turns the rod so that the arms will not align with the openings 20, and then resumes pulling the rod 11 and arms, bypassing the opening, toward the drain opening.

Figure 6:
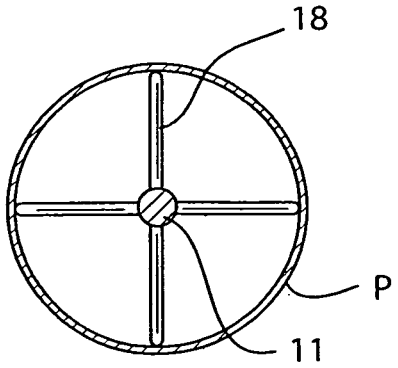
FIG. 6 illustrates a modification of the invention.

FIG. 6 illustrates much thinner arms 18 which would represent wires soldered or glued to the rod 11. These are generally of the same configuration as arms 12 or 15 and could include curved parts 13 or balls 16.

As indicated earlier, the drain cleaning device can be made out of metal or plastic. If metal, the arms 12, 15 or 18 would be either soldered or glued to the rod 11. If the arms were made out of plastic, they could be connected to the rod 11 in any suitable way or be molded as a single piece with rod 11.

As noted above, the present invention, whether utilized for large industrial drain pipes or smaller domestic drain pipes, has been described especially with respect to the latter. However, even in the case of domestic drain pipes, the device might well be suitable for professionals such as plumbers and the like, in which case the principles of the present invention would be applicable, but the device could be made out of much sturdier long-lasting materials.

Figure 4:
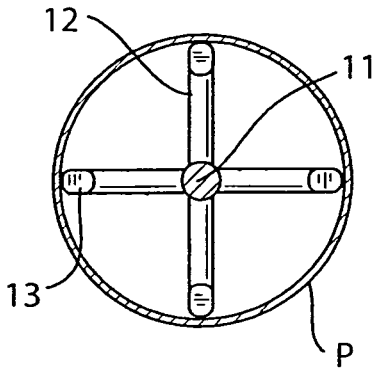
FIG. 4 is a plan view of FIG. 2, showing the arms only in the solid line position.
Figure 5:
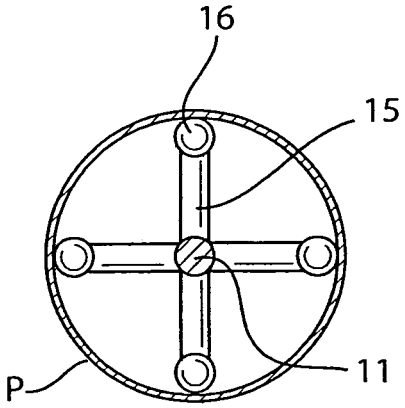
FIG. 5 is a plan view of FIG. 3, showing the arms only in the solid line position.
Figure 7A:
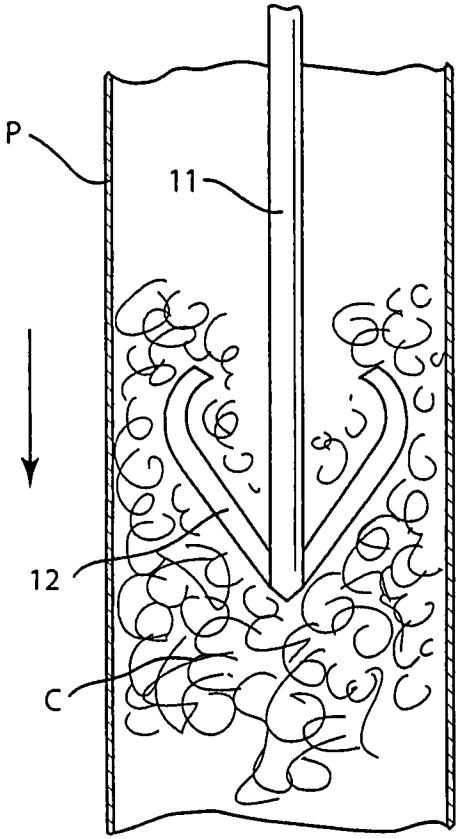
FIGS. 7A, 7B and 7C illustrate the operation of the device as it would operate at any location in the pipe such as in the U-shaped seal of FIG. 1, but wherein the illustrated portion of pipe is shown as straight and vertical in order to more clearly illustrate the operation of the invention.
Figure 7B:
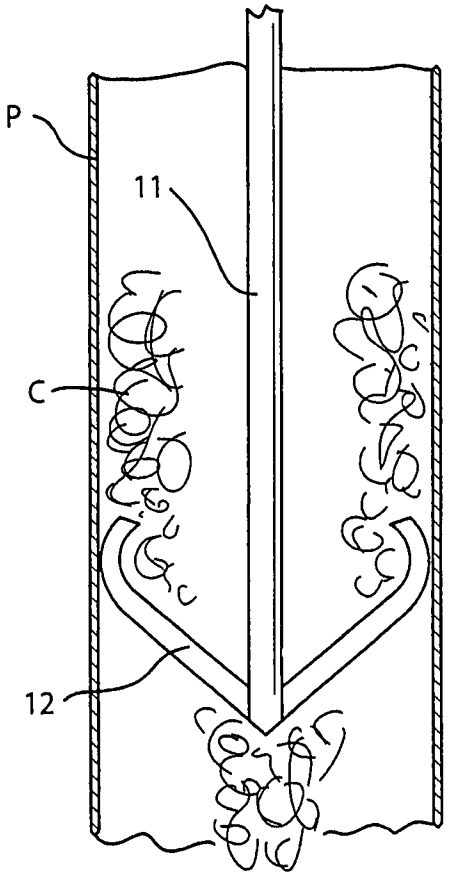
Figure 7C:
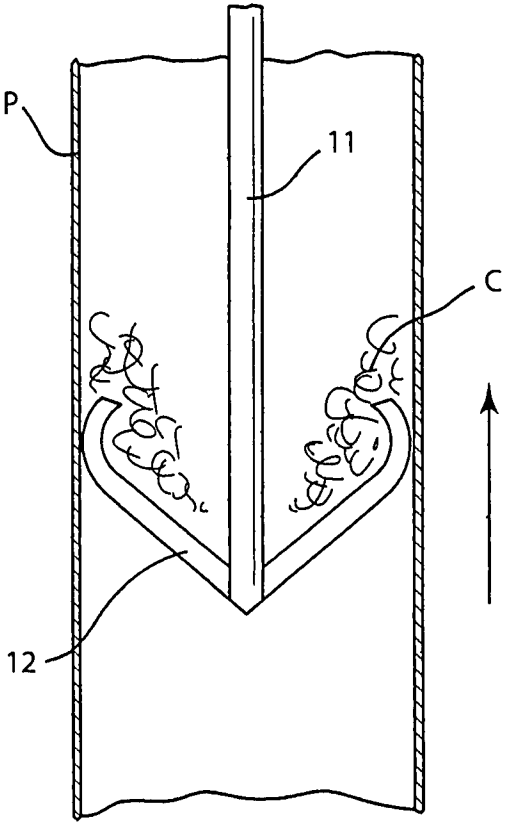

The operation of the invention is best shown with reference to FIGS. 7A, 7B and 7C, using the embodiment of FIGS. 2 and 4, but the same would be applicable for any embodiment. FIGS. 7A-C illustrate the invention in a simple vertical section of pipe. However, this operation as described herein would be applicable whether the illustrated sections were shown as horizontal or as part of a curved U-shaped water seal.

FIG. 7A illustrates movement of the device into a clog C. The clog would presumably present some resistance to the outward flexing of the arm 12 so that they might flex inwardly to some extent. At the same time, as the rod 11 and arms 12 move downwardly, the device would have a tendency to push some of the clog C downstream thereof and water flowing through the pipe could be used to push that part of the clog downstream. The spacing between the arms facilitates this downward movement through the clog. FIG. 7B illustrates that point in the operation when the device has pushed completely through the clog. The portion that it pushed downstream then flows downstream. However, a portion of the clog remains against the inside wall, resistant to downstream movement. In FIG. 7B the rod 11 has moved far enough that it has passed this resistant clog material, at which time the arms 12 will flex outwardly against the inside wall of the pipe. FIG. 7C then shows pulling of the rod and arms rearwardly back to the drain opening. The outwardly flexed arms 12 will grab essentially all of the remaining clog material and move rearwardly along the wall so as to pull all of this remaining clog material upwardly and out of the drain opening.

Of course it is possible that in the downward movement shown in FIG. 7A, the device will meet such resistance that it cannot move completely through the clog. At some such intermediate point, rearward movement of the rod would cause arms 12 to flex outwardly enough to carry with them at least some of the resistant clog. This procedure could be repeated several times so that removal of all of the clog material might be accomplished in steps rather than all at once.

Referring to FIG. 1, if during the rearward movement, an arm became caught up in a snag, such as in opening 20, the user would rotate the rod until the opening were located in a space between the arms, after which the rod would be pulled to continue its rearward movement, bypassing the snag and carrying the clog material with it to and through the drain opening.

Present invention also comprises as method of cleaning a drain pipe comprising pushing a device having a flexible rod with rearwardly extending, spaced apart, outwardly flexed arms through a drain pipe obstruction and then allowing the arms to flex outwardly against the inside wall of the pipe, and then pulling the obstruction material rearwardly to and out of the drain opening. The method of the present invention could include pushing at least a portion of the obstruction downstream, creating an opening for that material to be flushed out of the drain pipe, followed by pulling the device rearwardly toward the drain opening to carry and remove the remaining obstruction material which was not flushed out. If the obstruction is particularly resistant, the method could include moving the obstruction in steps including pushing the rod and arms only partially through the obstruction to grasp only a portion of the obstruction and pulling that portion back toward and out of the drain opening and then repeating that process as required.

In the operation of the device of the present invention or in accordance with the method of the present invention, it will often be suitable to turn the device as it is either pushing clog material downwardly through the pipe or pulling clog material back toward the drain opening.

Although the invention has been described in considerable detail, it will be apparent that the invention is capable of modifications and variations, apparent to those skilled in the art without departing from the spirit or scope of the invention.

I claim:

1. The method of cleaning a drain pipe by removing solid material caught in the drain pipe, which drain pipe has an inlet end at an inlet into the drain pipe and a downstream location located downstream from the inlet end, and an inside wall, the method comprising:

pushing a device into the drain pipe from the inlet end of the drain pipe, which device has a rod which is stiff enough to be pushed through the drain pipe but which is sufficiently flexible to go around bends in the drain pipe, and a plurality of arms attached to the rod at connections and extending from said connections toward the inlet end, the arms being resiliently biased against the inside wall of the drain pipe and the arms being circumferentially spaced apart from each other to create spaces between them and wherein each arm can flex resiliently independently of the other arms, the arms essentially centering the rod, in the vicinity of the arms, within the drain pipe, pushing the device into and through the solid material in the drain pipe, and once the arms have moved through the solid material, and with the arms flexed resiliently against the inside wall of the drain pipe, pulling the device in the direction toward the inlet end such that the arms engage and pull the solid material.

2. The method according to claim 1, including a step of pushing the arms completely through the solid material to create an opening in solid material.

3. The method according to claim 1, including rotating the device during the pushing and/or the pulling steps.

4. The method according to claim 1, including rotating the device during the pulling step to manipulate the arms around any protrusions or obstructions on the inside wall of the drain pipe.

5. The method according to claim 1, wherein the step of pulling the device is performed such that the ends of the arms farthest from said connections avoid getting caught in any protrusions or obstructions on the inside wall of the drain pipe.

6. A system for cleaning a drain pipe comprising:

a drain pipe to be cleaned to remove solid material caught in the drain pipe and a device moveable through the drain pipe to clean such solid material out of the drain pipe, the drain pipe including an inside wall and an inlet end where liquid enters the drain pipe, wherein the drain pipe extends from said inlet end to a downstream location to convey the liquid in a downstream direction away from the inlet end, the device being insertable into the drain pipe at said inlet end, the device having a proximal end and an opposite distal end, the device having a rod which is stiff enough to be pushed through the drain pipe but sufficiently flexible to go around bends in the drain pipe as the rod moves through the drain pipe, and a plurality of arms attached to the rod at connections and extending from said connections toward the proximal end of the device, the arms being circumferentially spaced apart from each other to create spaces between them, each arm being resiliently biased away from the rod, independently of the other arms, against the inside wall of the drain pipe, the arms essentially centering the rod in the vicinity of the arms within the drain pipe, the arms also being resiliently moveable toward the rod by solid material inside of the drain pipe which the arms engage as the device moves in the downstream direction.

7. The system according to claim 6, wherein the device comprises two arms.

8. The system according to claim 6, wherein the device comprises four arms.

* * * * *